US007762861B2

(12) United States Patent
Verfuerth et al.

(10) Patent No.: US 7,762,861 B2
(45) Date of Patent: Jul. 27, 2010

(54) METHOD AND APPARATUS FOR MOUNTING A LIGHT SLEEVE

(75) Inventors: Neal R. Verfuerth, Plymouth, WI (US); Anthony J. Bartol, Plymouth, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 266 days.

(21) Appl. No.: 12/070,651

(22) Filed: Feb. 20, 2008

(65) Prior Publication Data

US 2009/0209162 A1 Aug. 20, 2009

(51) Int. Cl.
*H01J 9/26* (2006.01)

(52) U.S. Cl. ..... 445/44

(58) Field of Classification Search ..... 445/23–25, 445/66

See application file for complete search history.

(56) References Cited

U.S. PATENT DOCUMENTS

| | | | |
|---|---|---|---|
| 2,382,939 | A | 8/1945 | Koch |
| 2,725,031 | A | 11/1955 | Campbell |
| 2,749,847 | A | 6/1956 | Bowles et al. |
| 3,247,004 | A | 4/1966 | Dosser |
| 4,112,485 | A | 9/1978 | Sutter |
| 4,229,780 | A | 10/1980 | Nelson |
| 4,312,028 | A | 1/1982 | Hamacher |
| 4,507,332 | A | 3/1985 | Nolan et al. |
| 4,924,368 | A | 5/1990 | Northrop et al. |
| 5,173,637 | A | 12/1992 | Sica |
| 5,536,998 | A | 7/1996 | Sica |
| 5,729,085 | A | 3/1998 | Sica et al. |
| 6,149,285 | A | 11/2000 | Cicarelli |
| 6,246,167 | B1 | 6/2001 | Sica |
| 6,365,226 | B1 | 4/2002 | Wu |
| 2007/0068950 | A1 | 3/2007 | Hine et al. |

*Primary Examiner*—Joseph L Williams
*Assistant Examiner*—Brenitra M Lee
(74) *Attorney, Agent, or Firm*—Foley & Lardner LLP

(57) ABSTRACT

One embodiment relates to a method of sealing a gap formed between each end cap of a fluorescent bulb and a protective sleeve, where the fluorescent bulb is disposed within the protective sleeve to form a bulb and sleeve assembly with the gap defined between an external surface of the end caps and an internal surface of the protective sleeve. The method comprises rotating the bulb and sleeve assembly and injecting a sealant in the gap associated with each end cap as the bulb and sleeve assembly rotate to provide a continuous bead of sealant between the end caps and the protective sleeve.

18 Claims, 7 Drawing Sheets

METHOD AND APPARATUS FOR MOUNTING A LIGHT SLEEVE

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The present disclosure relates generally to the field of fluorescent lamps. More specifically the disclosure relates to a method and apparatus of sealing the ends of a protective sleeve to a fluorescent lamp. It is known to provide a protective sleeve formed from a material such as polycarbonate for a fluorescent bulb. Such sleeves surround the bulb and are intended to contain shards of glass, and the phosphor powder that coats the inside of the bulb in the event of breakage. This is advantageous in environments involving food and food preparation such as food processing plants and supermarket displays. It is desirable to seal the ends of the sleeve to help contain any shards of glass, phosphors, or gasses within the sleeve if the bulb breaks.

One such method of sealing the ends includes affixing caps collars or other end fittings to the ends of the bulbs. Such end fittings generally overlap the sleeve and may be configured to be removable and reusable. However, such end fittings have several disadvantages. Whether removable or not, such end fittings are generally insufficient to properly seal the ends of the sleeve. The end fittings generally must be designed specifically for different bulb styles. Additionally, such end fittings may have a diameter that is too large to fit into some fixtures. End fittings often represent a relatively significant increase in cost for the finished bulb assembly.

Another method involves coating the end cap of the fluorescent bulb with an adhesive coating or a double-sided adhesive tape. Such methods generally require heating and mechanically deforming the ends of the sleeve (e.g., with a collet or similar mechanism) to create the seal between the bulb and the sleeve. However, such methods typically require the addition of a complicated step in the manufacturing process that may result in breakage or other damage to the sleeve of the bulb. In addition, it may be difficult to obtain a satisfactory seal with such methods due to the difficulty in forming polycarbonate tubes, and the difficulty in obtaining a durable and lasting seal with the adhesive tape.

It would be advantageous to provide an apparatus and method for sealing the ends of a protective sleeve to a fluorescent bulb that is relatively inexpensive and that provides an improved seal.

SUMMARY

One embodiment relates to a method of sealing a gap formed between each end cap of a fluorescent bulb and a protective sleeve, where the fluorescent bulb is disposed within the protective sleeve to form a bulb and sleeve assembly with the gap defined between an external surface of the end caps and an internal surface of the protective sleeve. The method comprises rotating the bulb and sleeve assembly and injecting a sealant in the gap associated with each end cap as the bulb and sleeve assembly rotate to provide a continuous bead of sealant between the end caps and the protective sleeve. The method may also include biasing the sleeve into an eccentric relationship with the bulb, to better accommodate insertion of a nozzle or needle into the gap.

Another embodiment relates to an apparatus for sealing a gap formed between each end cap of a fluorescent bulb and an overlying protective sleeve. The apparatus comprises a sealing station having a first roller and a second roller disposed substantially parallel to one another, a conveyor, a drive device, and a nozzle. The conveyor is operable to deliver the bulb and sleeve assembly to the rollers and to remove the bulb and sleeve from the rollers. The drive device is operable to rotate at least one of the rollers or the bulb and sleeve assembly at a predefined rotational speed. The nozzle is axially translatable between a retracted position to permit placement and removal of the bulb and sleeve assembly and an extended position within the gap to permit injection of a sealant through a flow path in the nozzle and into the gap as the bulb and sleeve assembly rotates on the rollers.

Another embodiment relates to a method of sealing a gap formed between each end cap of a fluorescent bulb and a protective sleeve, where the fluorescent bulb is disposed within the protective sleeve to form a bulb and sleeve assembly with the gap defined between an external surface of the end caps and an internal surface of the protective sleeve. The method includes the steps of positioning a nozzle in the gap, moving the nozzle in a substantially circular path defined by the gap while injecting a sealant from the nozzle and into the gap to form a bead having continuous contact with the end cap and the sleeve, and removing the nozzle from the gap.

Another embodiment relates to a method of sealing a gap formed between each end cap of a fluorescent bulb and a protective sleeve, where the fluorescent bulb is disposed within the protective sleeve to form a bulb and sleeve assembly with the gap defined between an external surface of the end caps and an internal surface of the protective sleeve. The method includes the steps of shifting the protective sleeve in one direction to a first offset position to expose one end cap, applying a bead of sealant along a circumference of the one end cap, shifting the protective sleeve in an opposite direction to a second offset position to expose the other end cap, applying a bead of sealant along a circumference of the other end cap, and shifting the protective sleeve to a centered position with each end of the protective sleeve substantially covering a respective end cap with a bead of sealant therebetween.

Another embodiment relates to an apparatus for sealing a gap formed between each end cap of a fluorescent bulb and a protective sleeve. The apparatus includes a sealing station operable to receive a bulb and sleeve assembly with the gap defined between an external surface of the end caps and an internal surface of the protective sleeve. The nozzle is axially translatable between a retracted position substantially free of engagement with the bulb and sleeve assembly and an extended position within the gap to permit injection of a sealant through a flow path in the nozzle and into the gap. The drive device is operable to move the nozzle in a substantially circular path defined by the gap to form a bead of the sealant having continuous contact with the end cap and the sleeve.

DETAILED DESCRIPTION

Figure 1A:
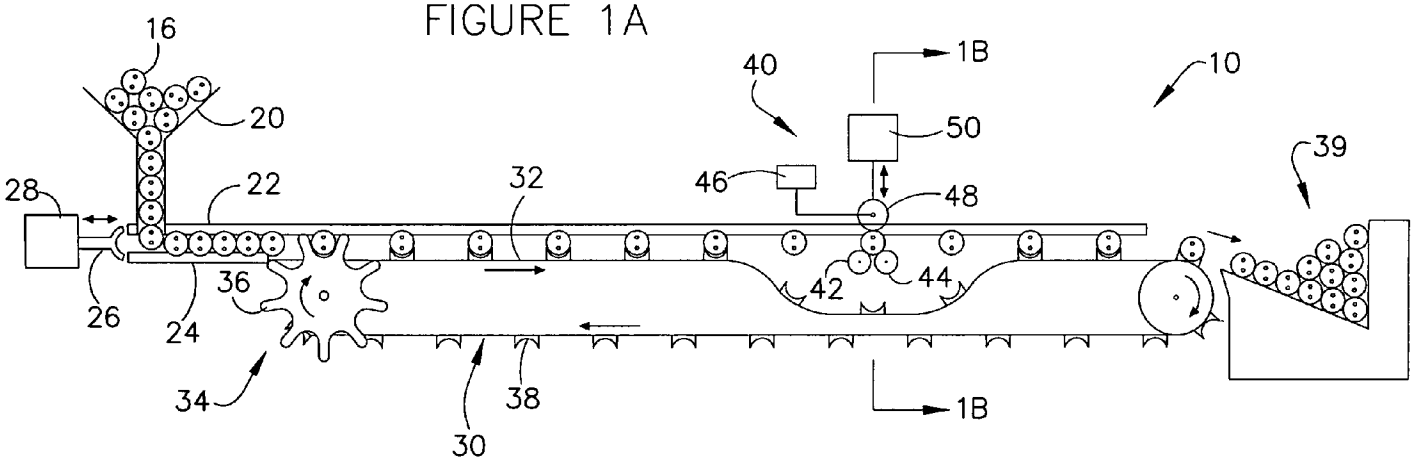
FIG. 1A is a schematic representation of a side view of an apparatus for sealing a gap formed between each end cap of a fluorescent bulb and an overlying protective sleeve according to one exemplary embodiment.
Figure 1C:
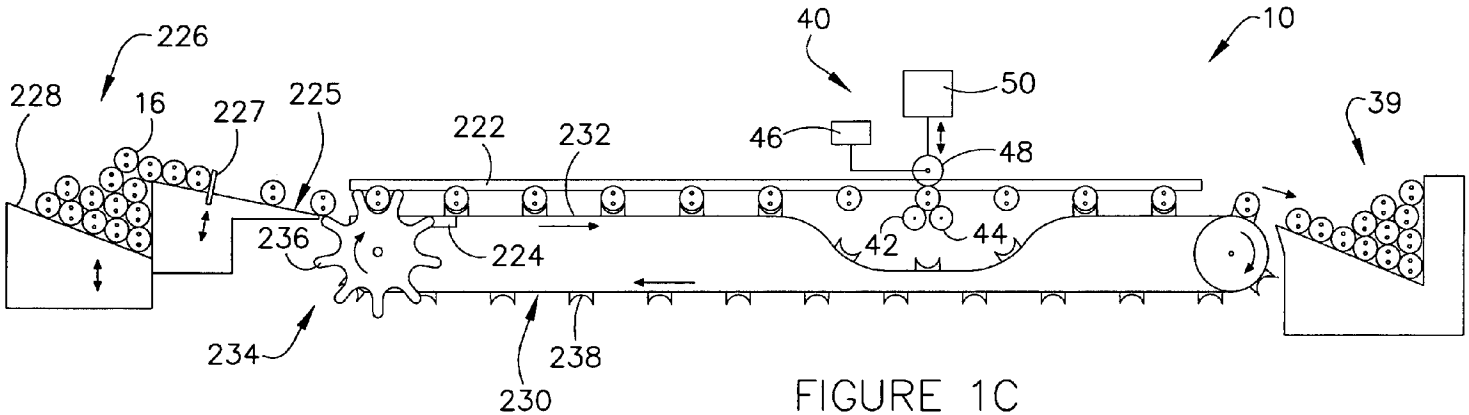
FIG. 1C is a schematic representation of a side view of an apparatus for sealing a gap formed between each end cap of a fluorescent bulb and an overlying protective sleeve according to another exemplary embodiment.

Referring generally to FIGS. 1A-1D, an apparatus 10 for sealing a gap formed between each end cap of a fluorescent bulb 12 and an overlying protective sleeve 14 is shown according to an exemplary embodiment. The bulb 12 is slid into the sleeve 14 to form a bulb and sleeve assembly 16. Typically, bulb 12 is an elongated lamp that includes a glass tube coated with phosphor salts. The ends of the glass tube are closed by metal end caps 18. End caps 18 are coupled to filaments provided within the glass tube and electrical contacts such as pins provided outside the glass tube that are configured to couple the lamp to a power source. Fluorescent lamps may break under a variety of circumstances, for example, by contact with other objects, or if at the end of the bulb life, the filament breaks and falls to contact the glass tube. The hot filament may thermally shock the glass and cause it to shatter. Sleeve 14 is intended to be a protective member that surrounds bulb 12 and is configured to contain glass shards, phosphor dust, gasses, and other hazardous materials (e.g., mercury, etc.) if bulb 12 is broken. According to an exemplary embodiment, sleeve 14 is formed from a generally transparent polymer (e.g. polycarbonate, etc.) with UV inhibitors. Apparatus 10 is provided to seal the ends of sleeve 14 to bulb 12 to prevent gas or debris from escaping sleeve 14. The protective sleeve 14 may be installed (e.g. placed, positioned, slid, pushed, etc.) over the bulb 12 using any one or more of a number of methods and equipment. For example, sleeve 14 may be positioned manually (e.g. by hand, or through manual operation of an appropriate tool, etc.), alternatively, the sleeve 14 may be pushed over the bulb using a linear actuator (such as an air cylinder or the like) that operates in a generally reciprocal manner to push a sleeve into position on a bulb. According to a further embodiment, the sleeve may be pushed onto the bulb using air pressure (e.g. "blowing" the sleeve onto the bulb). Any such method and equipment may be used to install the protective sleeve 14 over the bulb 12 to form the bulb and sleeve assembly 16, which may be formed separately and "stockpiled" for sealing of the ends by apparatus 10. According to an alternative embodiment, the apparatus for sealing the ends of the bulb and sleeve assembly may also be configured to install the sleeve over the bulb.

Figure 1B:
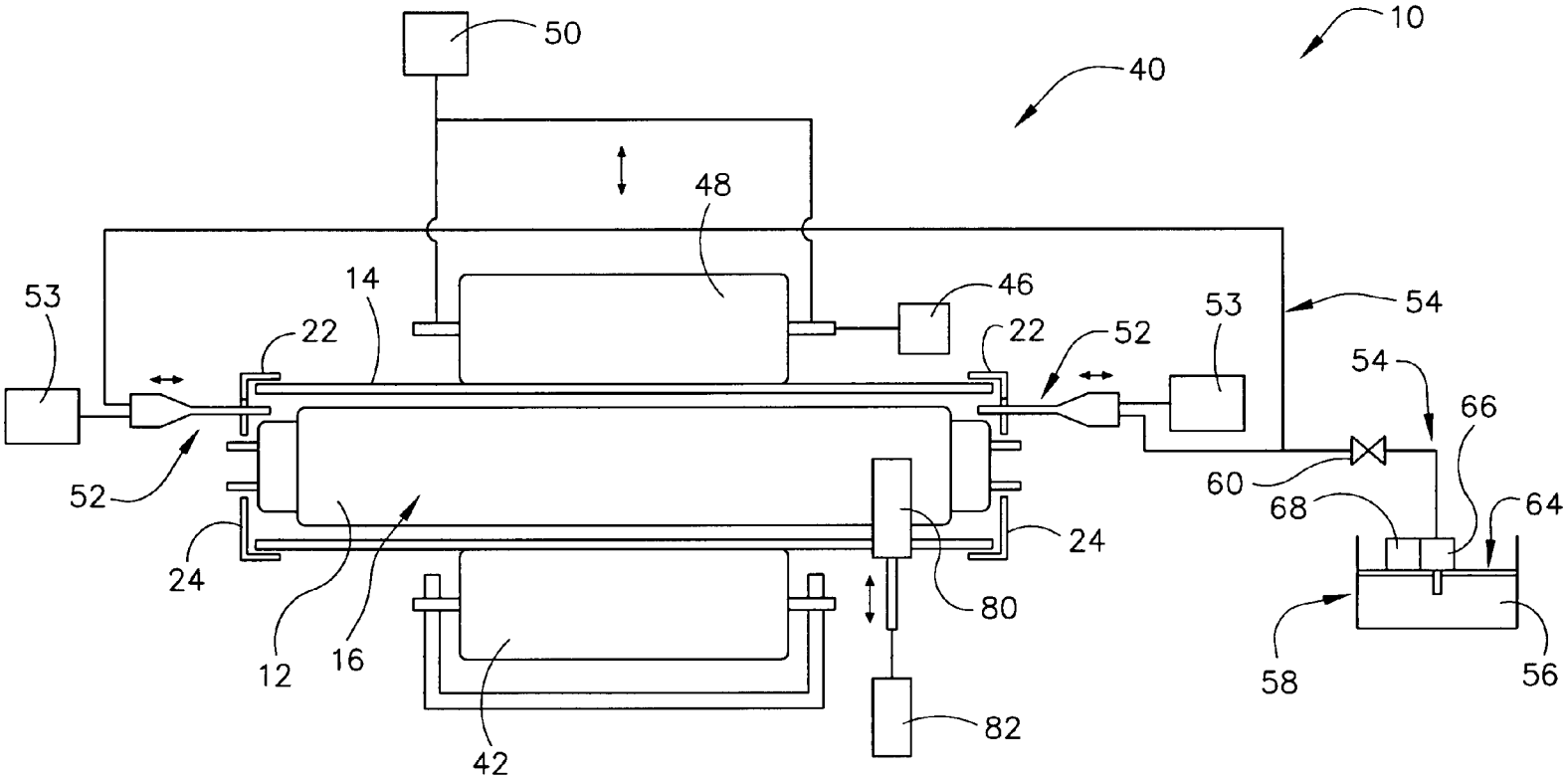
FIG. 1B is a schematic representation of a partial cross sectional view along lines 1B-1B of FIG. 1A according to one exemplary embodiment.

Referring further to FIGS. 1A and 1B, apparatus 10 includes a feeder device 20 (e.g. hopper, bin, etc.) for delivering a supply of bulb and sleeve assemblies 16 onto two pairs of spaced apart guide rails 22, 24 that are arranged to maintain an axially aligned position of the bulb 12 and sleeve 14 relative to one another and for guiding the bulb and tube assemblies 16 through the various stages of the sealing operation. According to one embodiment, the guide rails 22, 24 are vertically spaced a sufficient distance to permit the electrodes extending from each end cap to rotate between the guide rails 22, 24 without contacting the rails. Note that in FIG. 1A a portion of the guide rail 24 is not shown for clarity. A loading device 26 (e.g. "pusher" etc.) operates in a reciprocating manner to "push" the bulb and tube assemblies along the guide rails toward a moving conveyor 30 having a track 32 (e.g. belt, chain, caterpillar track, etc.). The loading device 26 operates at a frequency corresponding to the speed of the conveyor 30 and operation of the sealing station of the operation, and may be driven by any suitable device, such as a linear actuator 28 (e.g. air cylinder, etc.).

The conveyor track 32 operates to position and transport the bulb and sleeve assemblies 16 through various stages of the sealing operation. According to one embodiment, conveyor 30 includes a separator wheel 34 (e.g. toothed wheel, sprocket, etc.) having projections 36 that separate the bulb and sleeve assemblies 16 on the conveyor track 32 at a predetermined spacing interval, which corresponds to the spacing of holders 38 that are attached to the conveyor track 32 for maintaining the position of each bulb and sleeve assembly 16 on the conveyor 30. As the bulb and sleeve assemblies 16 approach the sealing station 40, the conveyor track 32 "descends" (e.g. lowers, etc.) so that the holders 38 deliver the bulb and tube assembly 16 to the sealing station 40. Upon sealing of the ends of the bulb and sleeve assembly 16, the assembly is recaptured on the holder 38 and delivered by the conveyor 30 to a packaging station 39 (e.g. bin, etc.) in preparation for shipping.

According to an alternative embodiment, the bulbs and sleeves may be assembled with one another on the conveyor. For example, the separator wheel may be beveled to permit sleeves to be installed over the bulbs as the bulbs are loaded on the conveyor. According to another alternative embodiment shown in FIG. 1C, the loading device 220 may be provided in the form of an elevating hopper 226 that has a sloped lower surface 228 configured to allow gravity loading of bulb and tube assemblies 16 onto a ramp 225. The ramp 225 is shown to include a reciprocating separator pin 227 that is extendably and retractably associated with the ramp 225 and that "meters" or permits gravity loading of the assemblies 16 onto the conveyor 230 at a frequency corresponding to the speed of the conveyor 230. The assemblies 16 are then transferred along conveyor belt 232 and captured between guide rails 222 and 224 to sealing station 40 (note that in FIG. 1C a portion of the guide rail 224 is not shown for clarity).

Referring further to FIGS. 1A and 1B, the sealing station 40 is shown in further detail according to an exemplary embodiment. Sealing station 40 is shown to include a generally parallel first roller 42 and second roller 44 to support the bulb and sleeve assembly 16, and a vertically reciprocal drive roller 48, a drive device 46 to rotate the drive roller 48 and rotate the bulb and sleeve assembly 16, and a nozzle 52 that injects a sealant between the ends of sleeve 14 and end caps 18. Upon loading of the bulb and sleeve assembly 16 onto rollers 42 and 44, drive roller 48 engages (e.g. descends into contact, etc.) with the assembly 16 to rotate the assembly 16 at a predetermined speed as provided by drive device 46. Positioning of drive roller 48 may be accomplished by a linear actuator 50 (e.g. air cylinder, etc.) or other suitable device. Upon completion of the sealing process, drive roller 48 disengages (e.g. "lifts up", etc.) and the assembly 16 is discharged from rollers 42, 44 onto its associated holder 38 for delivery by the conveyor 30 to the packaging station 39.

Referring further to FIGS. 1A and 1B, first roller 42 and second roller 44 cooperate to receive and rotate bulb and sleeve assembly 16. Rollers 42 and 44 may be substantially similar, for example, to rollers commonly used for conveyers. According to one exemplary embodiment, rollers 42 and 44 are arranged side by side such that bulb and sleeve assembly 16 may be received on and supported by both first roller 42 and second roller 44 in a "triangular" arrangement. A drive device 26 such as a variable speed electric motor provides a rotational force to the drive roller 48 upon engagement of the drive roller 48 with the assembly 16 to rotate bulb and sleeve assembly 16 about longitudinal axis 17. Alternatively, drive device 46 may be coupled directly to one or more of first roller 42, second roller 44, or bulb and sleeve assembly 16 or may be coupled to the components with a gear box or other intermediate component.

Nozzle 52 is provided to inject a sealant 56 between an outside surface of the end cap 18 of bulb 12 and an inside circumferential surface of sleeve 14. According to one embodiment, nozzle 52 is a needle-like member with a hollow flow path 54 (e.g., a "veterinary" type needle or the like) through which a sealant 56 flows. According to one preferred embodiment, the nozzle 52 comprises a hollow needle having an outside diameter of approximately 0.062 inches and an inside diameter of approximately 0.040 inches, although other dimensions may be used that are suitable for extension into the gap 70 and for injecting sealant 56 through the needle and into the gap. According to an alternative embodiment, the nozzle may be provided as an annular orifice configured for insertion into the gap and injection of the sealant in a one-shot type manner without having to rotate either the assembly or the nozzle. According to one exemplary embodiment, sealant 56 is contained in a reservoir 58 and is delivered from reservoir 58 through flow path 54. Sealant 56 may be forced from reservoir 58, for example with compressed air provided by a pressurization source. A valve 60, disposed between reservoir 58 and nozzle 52 controls the flow of sealant 56. According to one embodiment, the sealant 56 is contained in a reservoir 58 (e.g. container, bucket, pail, etc.) having a heated plate or platen 64 that rests (e.g. "floats", rides, etc.) on an upper surface of the sealant 56 to maintain a portion of the sealant 56 adjacent to (and beneath) the platen 64 in a warmed or melted state. A pump 66 (e.g. a positive displacement metering pump, etc.) driven by a motor 68 (e.g. electric motor or an air motor, etc.) rests on top of the heated platen 64 and draws a supply of sealant 56 from the warmed or melted portion beneath the platen 64 and delivers sealant to nozzle 52 (e.g. via heated hoses, tubes, pipes or the like that provide flow path 54).

Sealant 56 is an adhesive material that is at least partially viscous before curing. According to a preferred embodiment, sealant 56 is fast-setting (e.g. within 30 seconds) hot melt silicone. Hot melt silicone is desirable because it is relatively quick setting, forms a good bond, and is resistant to ultraviolet (UV) radiation. According to other exemplary embodiments, other silicone compounds (e.g., silicone caulk, two-part silicone foam, etc.) or any other suitable compound may be used to seal a gap 70 between the sleeve 14 and bulb 12.

Figure 2:
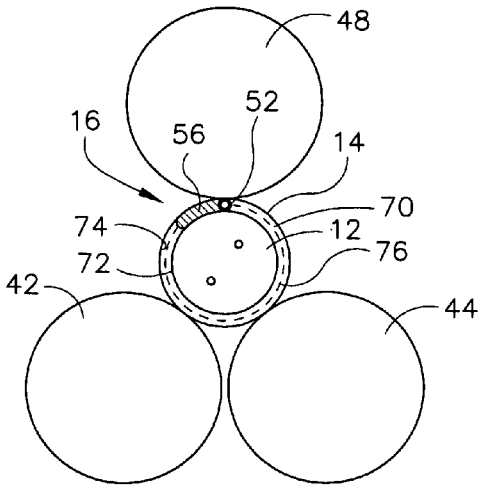
FIG. 2 is a schematic representation of an end view of the apparatus of FIG. 1A with a portion of the gap between the fluorescent bulb and the sleeve filled with a sealant.
Figure 3:
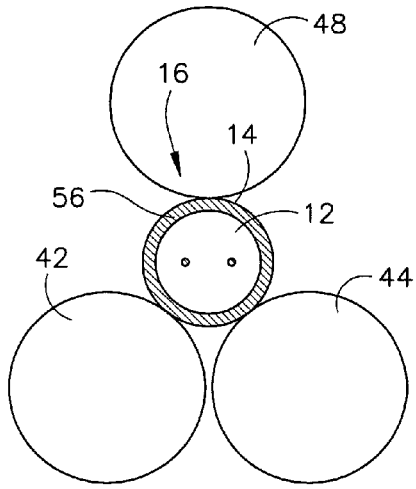
FIG. 3 is a schematic representation of an end view of the apparatus of FIG. 1A with the gap between the fluorescent bulb and the sleeve completely filled with a sealant.
Figure 4:
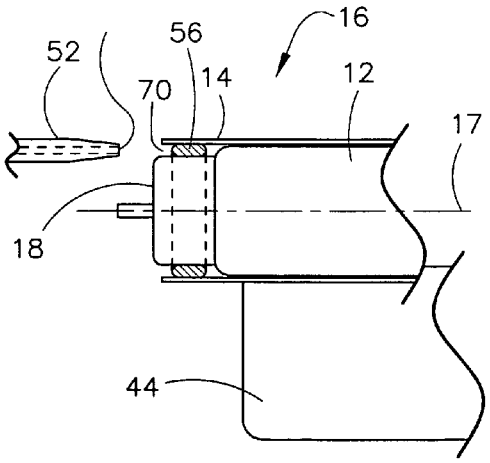
FIG. 4 is a schematic representation of a side view of the apparatus of FIG. 1A with the gap between the fluorescent bulb and the sleeve completely filled with a sealant.

As shown best in FIGS. 2-4, nozzle 52 is configured to be inserted through an opening (e.g. notch, aperture, etc.) in rail 22 and into a gap 70 between bulb 12 and sleeve 14 when nozzle 52 and bulb and sleeve assembly 16 are translated relative to each other. For example, the nozzle 52 may be linearly reciprocal between a retracted position (e.g. to permit loading and unloading of the bulb and sleeve assembly to/from the sealing station 40) and an extended position (e.g. for injecting a sealant to seal the gap between the bulb and sleeve). Nozzle 52 may be extended and retracted by a suitable device, shown as a linear actuator 53 (e.g. air cylinder, etc.). Gap 70 is an annular space defined at least partially by an external surface 72 of an end cap 18 and an internal surface 74 of protective sleep 14. It should be noted that the width of the gap between bulb 12 and sleeve 14 is exaggerated in FIGS. 2, 3, and 5 for clarity, and that the width of the gap may not be consistent along its circumference due to tolerance associated with manufacture of the bulb. Referring to FIG. 2, once nozzle 52 is inserted into gap 70, sealant 56 is extruded out of nozzle 52 along a circular path 76 in gap 70 as bulb and sleeve assembly 16 is rotated on rollers 42 and 44. Once bulb and sleeve assembly 16 has completed at least one full revolution, a continuous bead of sealant 56 is deposited between bulb 12 and sleeve 14, sealing gap 70. A sufficient amount of sealant 56 is provided to be able to seal gap 70 regardless of minor variations in the width of gap (e.g. due to manufacturing variations in bulb 12, etc.).

According to an alternative embodiment, the assembly 16 may remain stationary, and the nozzle 16 may be configured to move in a generally circular path defined by the gap 70 for sealing the gap 70. For example, the nozzle may be disposed within a corresponding circular track and moved about the track using actuators or other devices known to those having ordinary skill in the art. Also, the nozzle may be moved using suitable robotics, or alternatively may be moved using actuators, such as opposed air cylinders or the like. According to another alternative embodiment the bulb and sleeve assembly may be axially shifted (e.g. translated, reciprocated, etc.) in a back-and-forth like manner into engagement with a non-translating nozzle, in which case the assembly may rotate about its axis for injection of sealant from a stationary nozzle, or the nozzle may remain non-rotational as the nozzle is rotated to traverse the circumference of the gap to inject sealant for sealing the gap.

Figure 5:
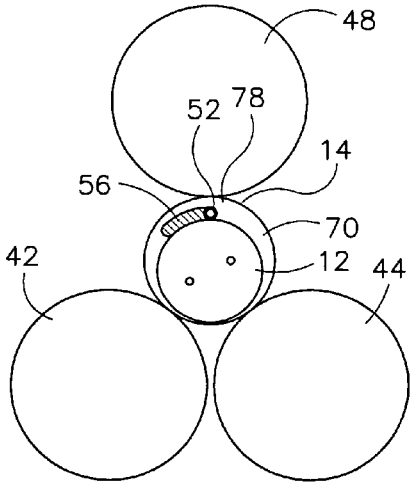
FIG. 5 is a schematic representation of an end view of the apparatus of FIG. 1A including a biasing member that increases the size of the gap between the bulb and the sleeve on one side.

According to one exemplary embodiment, apparatus 10 includes a biasing device operable to bias the sleeve 14 into an eccentric relationship with the bulb 12 (shown for example as an eccentric pusher 80 in FIG. 1B). Eccentric pusher 80 operates to bias the bulb 12 relative to sleeve 14 prior to the insertion of nozzle 52 such that gap 70 is wider at some point along the circumference (i.e. wider on one side than it is on the opposite side, etc.) to induce an eccentricity between the sleeve 14 and the bulb 12. The eccentric pusher 80 may be driven by an actuator 82 (such as an air cylinder or the like) between a retracted position where the eccentric pusher is disengaged from the bulb and sleeve assembly 16, and an applied position where the eccentric pusher engages a side of the sleeve 14 and applies a sufficient force to bias the sleeve 14 relative to the bulb 12. For example, eccentric pusher 80 may include a separate U-shaped element so that gap 70 is wider at the top as shown in FIG. 5. Nozzle 52 is inserted into the wider portion 78 of gap 70. As bulb and sleeve assembly 16 is rotated, sealant 56 is compressed between sleeve 14 and end cap 18, further assuring that sealant 32 will bond to both sleeve 14 and end cap 18.

A continuous bead of sealant 56 is intended to insure that glass shards, phosphor dust, gasses, and other hazardous materials (e.g., mercury) are contained within sleeve 14. A variety of different methods may be employed to fully seal gap 70. According to one exemplary embodiment, a known flow rate of sealant 56 and rotation speed of the bulb and sleeve assembly 16 may be used to calculate the time it take to apply a bead of sealant around the circumference of end cap 18. Further, assembly 16 may be slightly "over-rotated" to create an overlap between the two ends of the bead of sealant 56 and reduce the chance of a gap being left. According to another exemplary embodiment, an optical system may be used to sense when a complete bead of sealant 56 has been applied in gap 70. According to another exemplary embodiment, a pressure testing station may be provided to pressure test the assembly to ensure a complete seal has been established in gap 70.

Figure 1D:
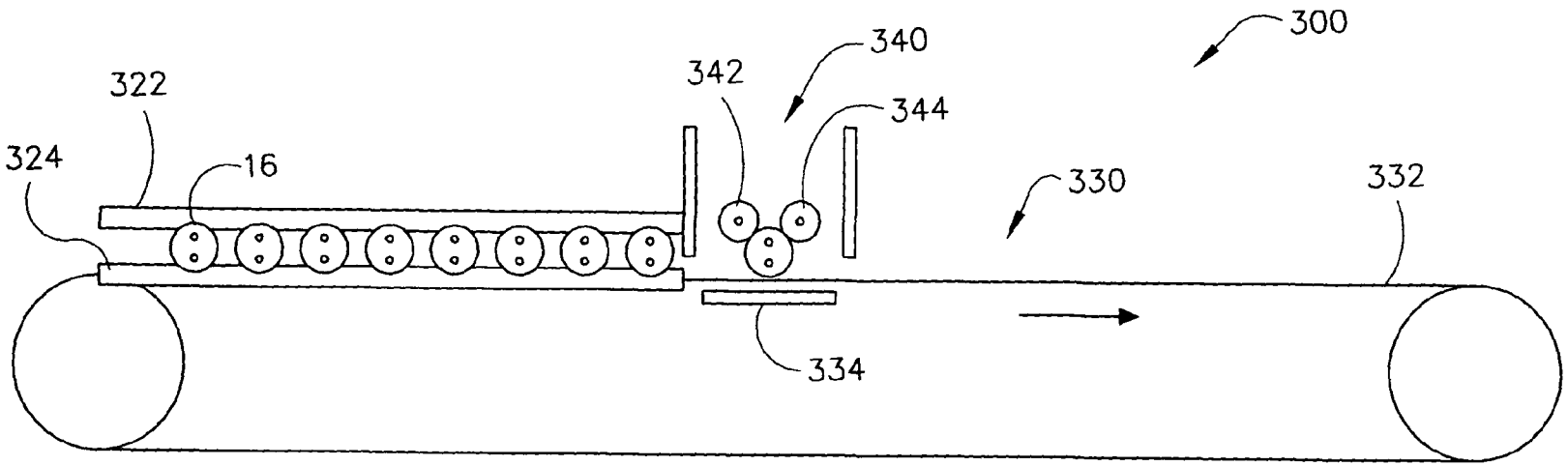
FIG. 1D is a schematic representation of a side view of an apparatus for sealing a gap formed between each end cap of a fluorescent bulb and an overlying protective sleeve according to a further exemplary embodiment.

Referring to FIG. 1D, an apparatus 300 for sealing a gap formed between each end cap of a fluorescent bulb 12 and an overlying protective sleeve 14 is shown according to another alternative embodiment. Apparatus 300 is shown to include a conveyor 330 having a track 332 (such as a "smooth" track) for receiving bulb and tube assemblies 16 along guide rails 322 and 324 (in a manner such as previously described with references to FIGS. 1A and 1C) and transporting the assemblies to a sealing station 340. Sealing station 340 includes a first roller 342 and a second roller 344 that are vertically reciprocal between a retracted (e.g. disengaged) position and an extended (e.g. engaged) sealing position. Any suitable device may be used to extend and retract the rollers, such as a linear actuator (e.g. air cylinder, etc.). Sealing station is also shown to include separators 346, shown has vertically reciprocal "gates" or the like that retract (e.g., "lift up", etc.) to permit transport of an assembly into the sealing station and extend to prevent entry of other assemblies until the sealing step is completed. Conveyor 330 further includes a backing support 334 to support conveyor track 332 as it travels through the sealing station 340. In operation, the separators 346 retract and the conveyor track transports an assembly 16 into the sealing station. Next, the separators 346 and rollers 342 and 344 descend into their extended position. The rollers bear against the assembly 16 and provide "free-wheel" support to the assembly as the moving conveyor track 332 (supported by backing support 334) rotates the assembly 16 against rollers 342 and 344. The gap between the sleeve and bulb is then sealed in a manner such as previously described.

According to the exemplary embodiments illustrated in FIGS. 1A-1D, the sealing apparatus is shown in a generally horizontal configuration. According to alternative embodiments, the components of the sealing apparatus may be arranged in other suitable configurations. For example, the sealing apparatus may be configured in a circular or rotary arrangement, or the sealing apparatus may be configured in a generally vertical arrangement (e.g. for gravity-feed of the assemblies to the sealing station, etc.), or any of a variety of other configurations.

Figure 6:
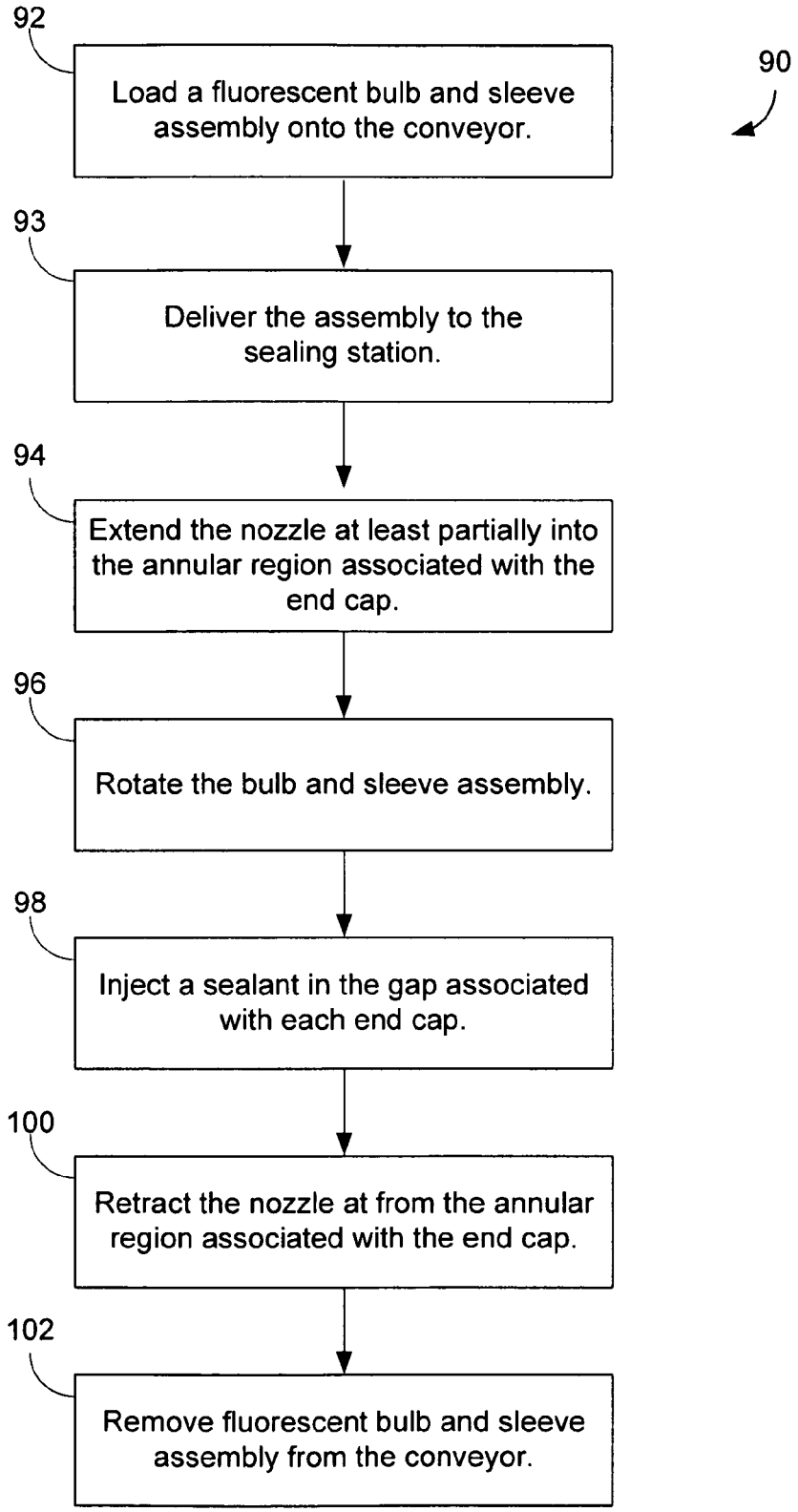
FIG. 6 is a flowchart of a method of sealing a gap formed between each end cap of a fluorescent bulb and a protective sleeve according to one exemplary embodiment.

Referring to FIGS. 5-8, the nozzle 52 and bulb and sleeve assembly 16 may be moved relative to each other to insert nozzle 52 into gap 70 according to various methods. Referring to FIG. 6, according to one exemplary embodiment, a method 90 includes a stationary bulb and sleeve assembly 16 and one or more moveable nozzles 52. In a first step 92, bulb and sleeve assembly 16 is loaded onto conveyor 30. In a second step 93, the assembly 16 is delivered by the conveyor to the sealing station 40. In a third step 94, nozzle 52 is inserted into gap 70 between bulb 12 and sleeve 14. According to an exemplary embodiment, nozzles 52 are provided on either side of assembly 16 such that gaps 70 on either side of assembly 16 are sealed simultaneously. In a fourth step 96, drive roller 48 engaged the assembly 16 and drive device 46 rotates assembly 16. In a fifth step 98, sealant 56 is injected into gaps 70. In a sixth step 100, nozzles 52 are retracted from gaps 70. In a seventh step 102, assembly 16 is removed from apparatus 10 by carriage 20.

Figure 7:
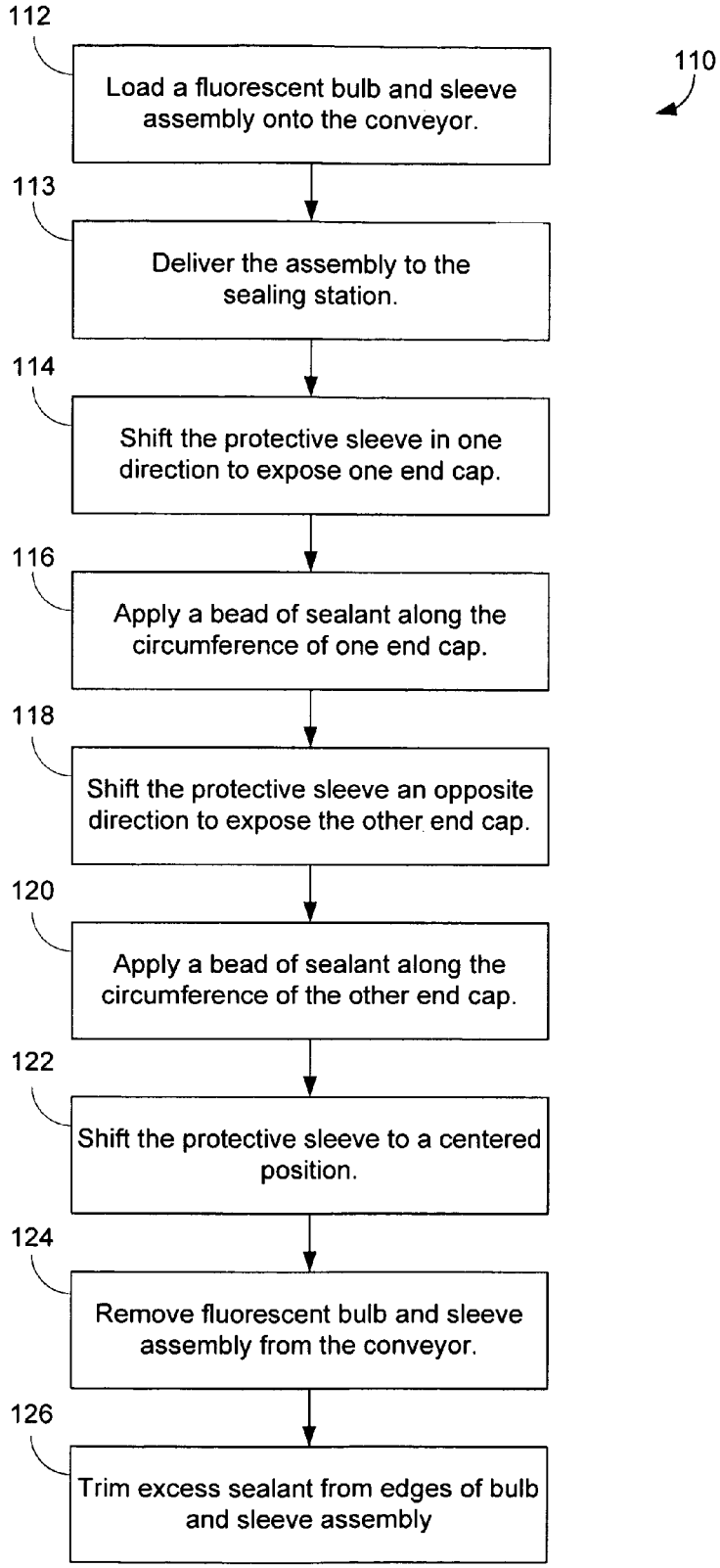
FIG. 7 is a flowchart of a method of sealing a gap formed between each end cap of a fluorescent bulb and a protective sleeve according to another exemplary embodiment.

Referring to FIG. 7, according to another exemplary embodiment, a method 110 includes a two-step shifting process where protective sleeve 14 is shifted relative to bulb 12. In a first step 112, bulb and sleeve assembly 16 is loaded onto conveyor 30. In a second step 113, the assembly 16 is delivered by the conveyor to the sealing station 40. In a third step 114, sleeve 14 is shifted relative to bulb 12 in one direction to expose one of end caps 18. In a fourth step 116, a bead of sealant 56 is applied to the exposed end cap 18. In a fifth step 118, sleeve 14 is shifted relative to bulb 12 in the opposite direction to expose the other end cap 18. In a sixth step 120, a bead of sealant 56 is applied to the exposed end cap 18. In a seventh step 122, sleeve 14 is shifted relative to bulb 12 back to it's original position such that it is generally centered on bulb 12. In an eighth step 124, assembly 16 is removed from the conveyor 30. According to one embodiment where the sleeve has a cross-sectional shape that is out-of-round (e.g. oval, elliptical, egg-shaped, etc.—such as may be due to manufacturing tolerances of the sleeve) a shaping device (such as a close-fitting circular tube, fixture, chuck or the like may be provided over the sleeve to "force" the sleeve into a circular shape to enhance the coverage characteristics of the bead and to reduce the amount of sealant that may be pushed (e.g. wiped, etc.) from the gap as the sleeve and bulb are shifted relative to one another. According to a further embodiment, an additional step 126 may be included to trim (e.g. remove, clean, etc.) any excess sealant that is exposed or remains or migrates beyond either edge of the sleeve and onto an exposed portion of the end cap when the sleeve is shifted to its final centered position.

Figure 8:
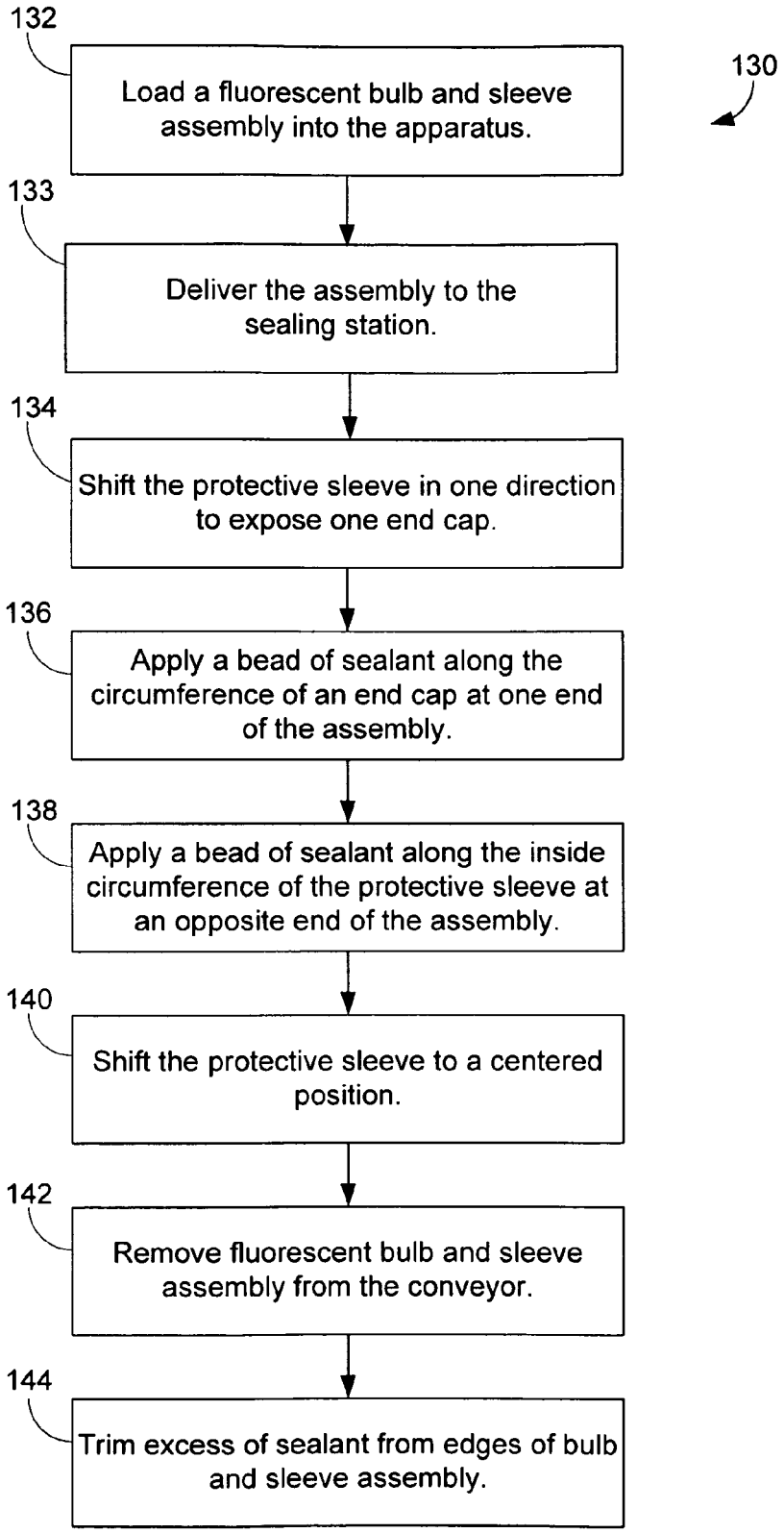
FIG. 8 is a flowchart of a method of sealing a gap formed between each end cap of a fluorescent bulb and a protective sleeve according to another exemplary embodiment.

Referring to FIG. 8, according to another exemplary embodiment, a method 130 includes a one-step shifting process where protective sleeve 14 is shifted relative to bulb 12. In a first step 132, bulb and sleeve assembly 16 is loaded onto conveyor 30. In a second step 133, the assembly 16 is delivered by the conveyor to the sealing station 40. In a third step 134, sleeve 14 is shifted relative to bulb 12 in one direction to expose one of end caps 18. In a fourth step 136, a bead of sealant 56 is applied to the exposed end cap 18 on one end of the assembly. In a fifth step 138 a bead of sealant is applied to an inside circumferential surface of the sleeve 14 on the opposite end of the assembly. In a sixth step 140 sleeve 14 is shifted relative to bulb 12 back to it's original position such that it is generally centered on bulb 12. In a seventh step 142, assembly 16 is removed from the conveyor 30. According to one embodiment where the sleeve has a cross-sectional shape that is out-of-round (e.g. oval, elliptical, egg-shaped, etc.—such as may be due to manufacturing tolerances of the sleeve) a shaping device (such as a close-fitting circular tube, fixture, chuck or the like may be provided over the sleeve to "force" the sleeve into a circular shape to enhance the coverage characteristics of the bead and to reduce the amount of sealant that may be pushed (e.g. wiped, etc.) from the gap as the sleeve and bulb are shifted relative to one another. According to a further embodiment, an additional step 144 may be included to trim (e.g. remove, clean, etc.) any excess sealant that is exposed or remains or migrates beyond either edge of the sleeve and onto an exposed portion of the end cap when the sleeve is shifted to its final centered position.

Sealant 56 advantageously creates a relatively low-cost seal between sleeve 14 and bulb 12. Further, sealant 56 does not add as much bulk to the finished assembly as a separate end cap the fits over the end of sleeve 14 and bulb 12. This allows bulbs 12 with sleeves 14 to be packaged similar to stock tubular fluorescent lamps (e.g., in boxes with cardboard trays that receive the ends of the bulbs). Sealant 32 does not obstruct the electrical connectors coupled to end caps 18. The disclosed method further creates a seal between sleeve 14 and bulb 12 without a secondary mechanical compression step as is sometimes needed with a pressure sensitive adhesive or 2-sided tape.

It is also important to note that the arrangement of the apparatus and method, as shown, are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited herein. Many modifications are possible without departing from the scope of the invention unless specifically recited in the claims. For example, the sealant may be introduced to the gap in any of a wide variety of ways, such as spraying the sealant from a nozzle positioned within the gap, or positioned external to the gap. Further, the sealant may have properties that cause expansion of the sealant upon injection into the gap to further enhance sealing of irregularly shaped gaps between the end caps of the bulb and the inner surface of the sleeve. Accordingly, all such modifications are intended to be included within the scope of the present disclosure as described herein. The order or sequence of any process or method steps may be varied or re-sequenced according to alternative embodiments. Other substitutions, modifications, changes, and/or omissions may be made in the design, operating conditions and arrangement of the preferred and other exemplary embodiments without departing from the exemplary embodiments of the present disclosure as expressed herein.

What is claimed is:

1. An apparatus for sealing a gap formed between each end cap of a fluorescent bulb and an overlying protective sleeve, comprising:

a first roller and a second roller disposed substantially parallel to one another;

a conveyor operable to transport the bulb and sleeve assembly to the rollers and to transport the bulb and sleeve assembly from the rollers;

a drive device operable to rotate at least one of the rollers or the bulb and sleeve assembly at a predetermined rotational speed; and a nozzle axially translatable between a retracted position to permit placement and removal of the bulb and sleeve assembly and an extended position within the gap to permit injection of a sealant through a flow path in the nozzle and into the gap as the bulb and sleeve assembly rotates on the rollers.

2. The apparatus of claim 1 further comprising a reservoir to contain a supply of the sealant.

3. The apparatus of claim 2 further comprising a valve operable to control a flow of the sealant from the reservoir and through the nozzle.

4. The apparatus of claim 3 further comprising a pressurization source operable to inject the sealant through the flow path in the nozzle.

5. The apparatus of claim 4 wherein the nozzle is a needle.

6. The apparatus of claim 1 wherein the drive device is a variable speed motor.

7. An apparatus for sealing a gap formed between each end cap of a fluorescent bulb and a protective sleeve, comprising:

a sealing station operable to receive a bulb and sleeve assembly with the gap defined between an external surface of the end caps and an internal surface of the protective sleeve;

a first nozzle and a second nozzle, each nozzle axially translatable between a retracted position substantially free of engagement with the bulb and sleeve assembly and an extended position within the gap to permit injection of a sealant through a flow path in the nozzles and into the gap at each end cap; and a drive device operable to move the nozzles in a substantially circular path defined by the gap to form a bead of the sealant having continuous contact with the end cap and the sleeve at each end of the fluorescent bulb.

8. The apparatus of claim 7 further comprising a reservoir to contain a supply of the sealant.

9. The apparatus of claim 8 further comprising a valve operable to control a flow of the sealant from the reservoir and through a flow path in each nozzle.

10. The apparatus of claim 9 further comprising a pressurization source operable to inject the sealant through the flow path in each nozzle.

11. The apparatus of claim 10 wherein each nozzle comprises a needle.

12. The apparatus of claim 7 wherein the drive device comprises a variable speed motor.

13. An apparatus for sealing a gap formed between each end cap of a fluorescent bulb and an overlying protective sleeve, comprising:

a sealing station operable to receive a bulb and sleeve assembly with the gap defined between an external surface of the end caps and an internal surface of the protective sleeve;

a drive device operable to rotate the bulb and sleeve assembly at a predetermined rotational speed; and a nozzle axially translatable between a retracted position to permit placement and removal of the bulb and sleeve assembly and an extended position at least partially within the gap to permit injection of a sealant into the gap as the bulb and sleeve assembly rotates.

14. The apparatus of claim 13 further comprising a reservoir to contain a supply of the sealant.

15. The apparatus of claim 14 further comprising a valve operable to control a flow of the sealant from the reservoir and through a flow path in the nozzle.

16. The apparatus of claim 15 further comprising a pressurization source operable to inject the sealant through the flow path in the nozzle.

17. The apparatus of claim 16 wherein the nozzle comprises a needle.

18. The apparatus of claim 13 wherein the drive device comprises a variable speed motor.

* * * * *